US006053080A

United States Patent [19]

Kaneyama et al.

[11] Patent Number: 6,053,080

[45] Date of Patent: Apr. 25, 2000

[54] DEVICE FOR TIGHTENING BOLT AND/OR NUT

[75] Inventors: Yasunobu Kaneyama, Osaka; Daijiro Yano, Tondabayashi; Shinji Fukuhara, Hirakata; Shozo Matsumura; Kenji Sato, both of Toyonaka; Yoshiyuki Umemoto, Osaka, all of Japan

[73] Assignee: Maeda Metal Industries, Ltd., Japan

[21] Appl. No.: 09/179,108

[22] Filed: Oct. 26, 1998

[30] Foreign Application Priority Data

Oct. 29, 1997 [JP] Japan ..... 9-296961

[51] Int. Cl.[7] ..... B25B 23/151; B25B 23/157

[52] U.S. Cl. ..... 81/469; 81/473; 81/475; 81/57.13; 81/57.29

[58] Field of Search ..... 81/469, 473, 475, 81/476, 54, 57.11

[56] References Cited

U.S. PATENT DOCUMENTS 4,462,282 7/1984 Biek ..... 81/57.11

4,485,698 12/1984 Adman et al. ..... 81/57.11

*Primary Examiner*—David A. Scherbel
*Assistant Examiner*—Hadi Shakeri
*Attorney, Agent, or Firm*—Bracewell & Patterson L.L.P.

[57] ABSTRACT

A device for tightening a bolt or a nut has a tightening socket which is releasable from biting engagement with the bolt or nut by disengaging a clutch in a rotation transmission system after completion of tightening, and which is made readily removable from the bolt or nut. The device is characterized in that it comprises power transmission means for coupling a socket drive motor to the socket for power transmission, the clutch incorporated in the power transmission means for selectively effecting or interrupting power transmission from the motor to the socket by a sliding movement, and clutch control means for selectively moving the clutch to an engaged position or a disengaged position. The clutch is moved to the disengaged position by the clutch control means after the motor is deenergized, whereby residual torque delivered by the motor to the bolt or the nut is removed to preclude biting engagement of the socket with the bolt or nut.

4 Claims, 8 Drawing Sheets

DEVICE FOR TIGHTENING BOLT AND/OR NUT

FIELD OF THE INVENTION

The present invention relates to a device for tightening bolts and/or nuts which has a tightening socket releasable from biting engagement with the bolt and/or nut after completion of tightening.

BACKGROUND OF THE INVENTION

Devices for tightening bolts and/or nuts comprise a socket for tightening up the bolt and/or the nut, and a socket drive motor serving as a power source and coupled to the tightening socket by power transmission means.

Such tightening devices are already provided wherein the socket drive motor is deenergized by a controller when tightening torque not smaller than a predetermined value acts on the tightening socket to stop the rotation of the socket.

When the device is used for tightening a bolt and/or a nut, torsional deformation occurs in the shafting members included in the power transmission means to the bolt and/or nut. Although the torsion is removed to some extent on completion of tightening, residual torque due to the torsional deformation remains in the shafting members.

The residual torque produces frictional resistance (hereinafter referred to as "biting engagement") between the tightening socket and the bolt and/or nut, rendering the socket unremovable from the bolt and/or nut.

A great force of biting engagement occurs especially in the case of tightening devices wherein the casing of the device is provided with a projecting reaction arm and which are used for tightening with the reaction arm pressed against a contact member in the vicinity of the portion to be fastened, and also in the case of tightening devices having an inner socket engageable with a tip at the forward end of a bolt and an outer socket coaxial with the inner socket and engageable with the nut and which receives a tightening reaction by the tip at the bolt end and the inner socket.

To preclude such biting engagement, it is practice to reversely rotate the socket drive motor on completion of tightening to forcibly release the tightening socket from biting engagement with the bolt and/or nut, whereas the motor which is reversibly rotatable requires a more complex motor control system and makes the device more cumbersome to use than when the motor is rotatable in only one direction.

The present invention provides a device for tightening bolts and/or nuts having a tightening socket which is releasable from biting engagement with the bolt and/or nut by disengaging a clutch in a rotation transmission system on completion of tightening, and which is made readily removable from the bolt and/or nut.

SUMMARY OF THE INVENTION

The present invention provides a device for tightening a bolt and/or a nut comprising a socket for tightening up the bolt and/or the nut, a socket drive motor for rotating the socket, and a controller for deenergizing the socket drive motor when tightening torque not smaller than a predetermined value acts on the socket, the bolt and/or nut tightening device being characterized in that the device comprises power transmission means for coupling the socket drive motor to the socket for power transmission, a clutch incorporated in the power transmission means for selectively effecting or interrupting power transmission from the socket drive motor to the socket by a sliding movement, and clutch control means for selectively moving the clutch to an engaged position or a disengaged position, the clutch being movable to the disengaged position by the clutch control means after the socket drive motor is deenergized, whereby residual torque delivered by the motor to the bolt and/or the nut is removed to preclude biting engagement of the socket with the bolt and/or nut.

Preferably the power transmission means comprises an output dividing means for outputting the power of the socket drive motor dividedly to two systems downstream from the clutch, one of the outputs being transmitted to the socket, the other output being transmitted to a ring rotatably disposed around the socket and having a reaction arm for receiving a tightening reaction.

Preferably the clutch control means is a solenoid controllable by the controller, and the controller operates the solenoid to move the clutch to the disengaged position after deenergizing the socket drive motor, whereby the residual torque delivered by the motor to the bolt and/or the nut is removed to preclude the biting engagement of the socket with the bolt and/or nut.

Alternatively, the tightening device comprises a trigger for controlling energization and deenergization of the socket drive motor, the trigger being biased in a deenergization direction by a spring and slidingly pushable in an energization direction against the spring when gripped by the user's hand, the clutch control means being coupled to the trigger to move the clutch to the engaged position when the trigger is moved in the energization direction and to move the clutch to the disengaged position when the trigger is moved in the deenergization direction.

When tightening torque not smaller than the predetermined value acts on the socket of the tightening device of the invention, the controller deenergizes the socket drive motor, and the clutch control means disengages the clutch after the socket in rotation is brought to a halt. This removes the residual torque from the shafting members included in the power transmission means to the bolt and/or nut, precluding the biting engagement of the socket with the bolt and/or nut.

Especially when the tightening device has the reaction arm, the removal of the residual torque renders the device readily removable from the bolt and/or nut.

When the clutch control means comprises a solenoid and is operatively connected to a trigger, the disengagement of the clutch obviates the biting engagement of the socket with the bolt and/or nut, so that the socket is easily removable from the bolt and/or nut by pulling the tightening device out of engagement with the bolt and/or nut.

DESCRIPTION OF THE PREFERRED EMBODIMENTS

A description will be given below of embodiments having one tightening socket 2 engageable with a nut, whereas the present invention is not limited to these embodiments but can be embodied as tightening devices having an inner socket engageable with a tip at the forward end of a bolt and an outer socket coaxial with the inner socket and engageable with a nut.

Figure 1:
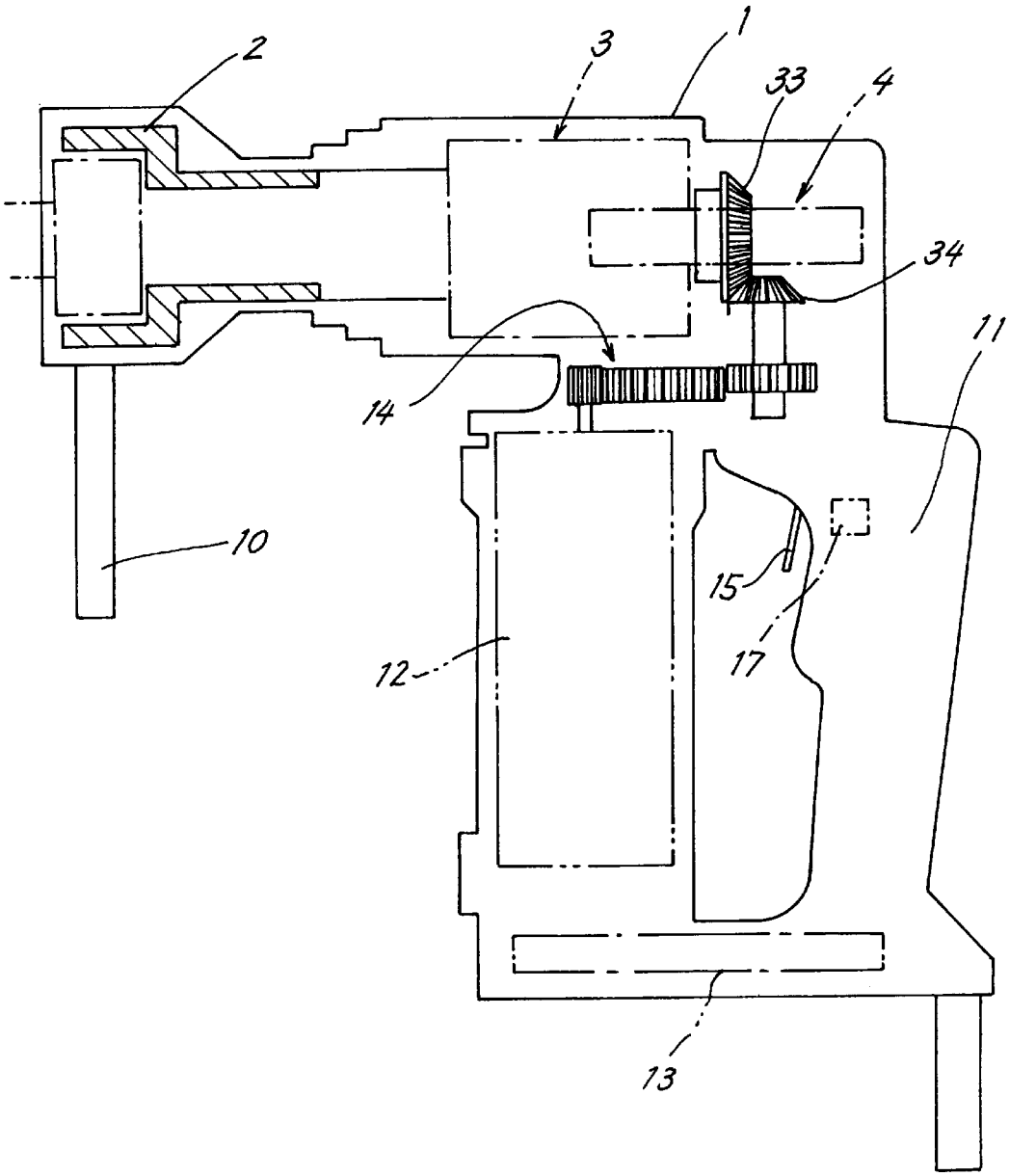
FIG. 1 is a diagram schematically illustrating a bolt and/or nut tightening device.
Figure 2:
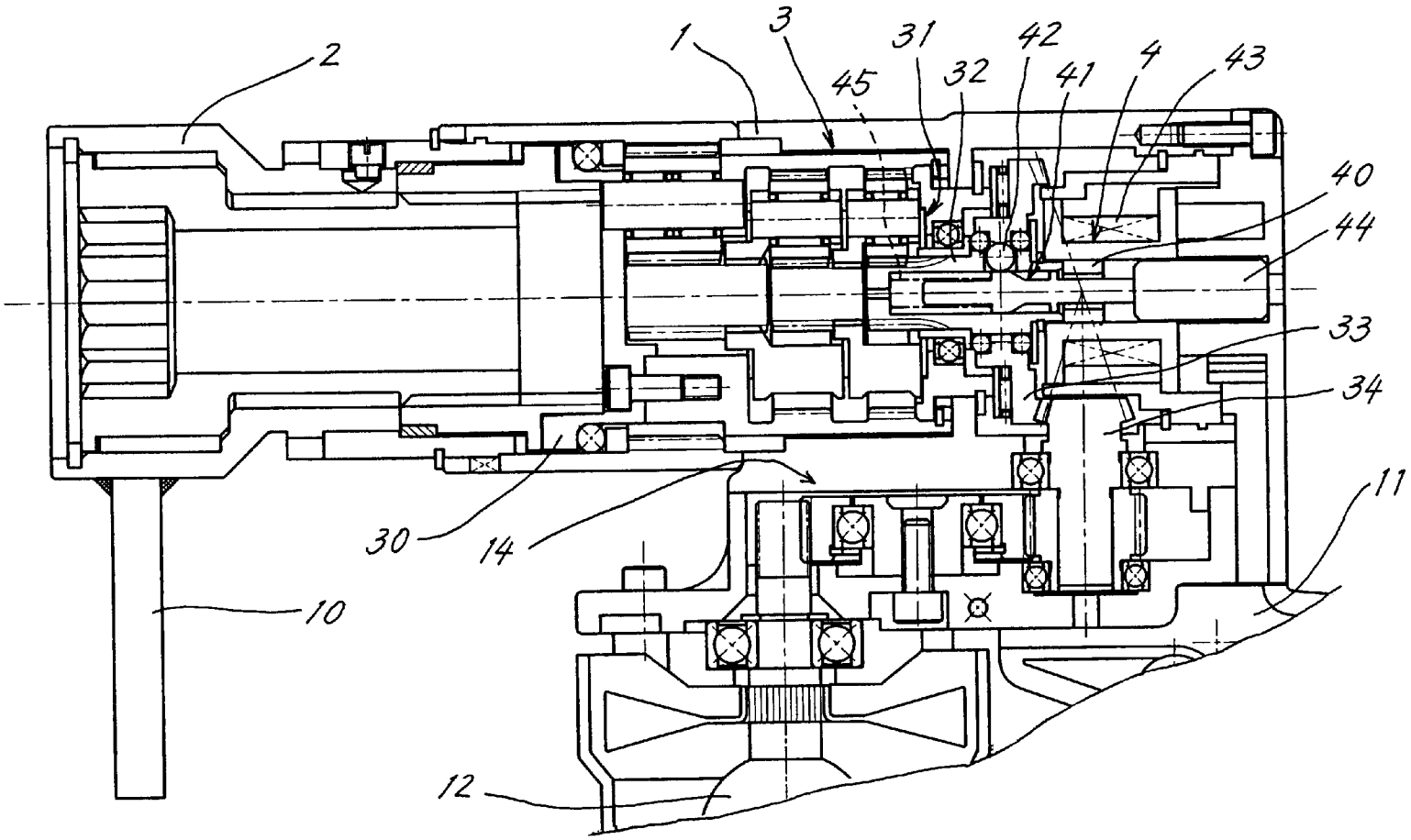
FIG. 2 is a fragmentary sectional view of the tightening device wherein a solenoid is used as clutch control means.

FIGS. 1 and 2 show a tightening device which comprises the tightening socket 2 as rotatably housed in the forward end of a casing 1, and a planetary gear reduction mechanism 3 serving as output dividing means and housed in the casing 1 for delivering opposite torques to the casing 1 and the socket 2, respectively. Provided externally of the casing 1 are a handle 11 and a socket drive motor 12 which are arranged approximately parallel. In the following description, the term "front" refers to the socket (2) side, and the term "rear" to the handle (11) side.

Figure 10:
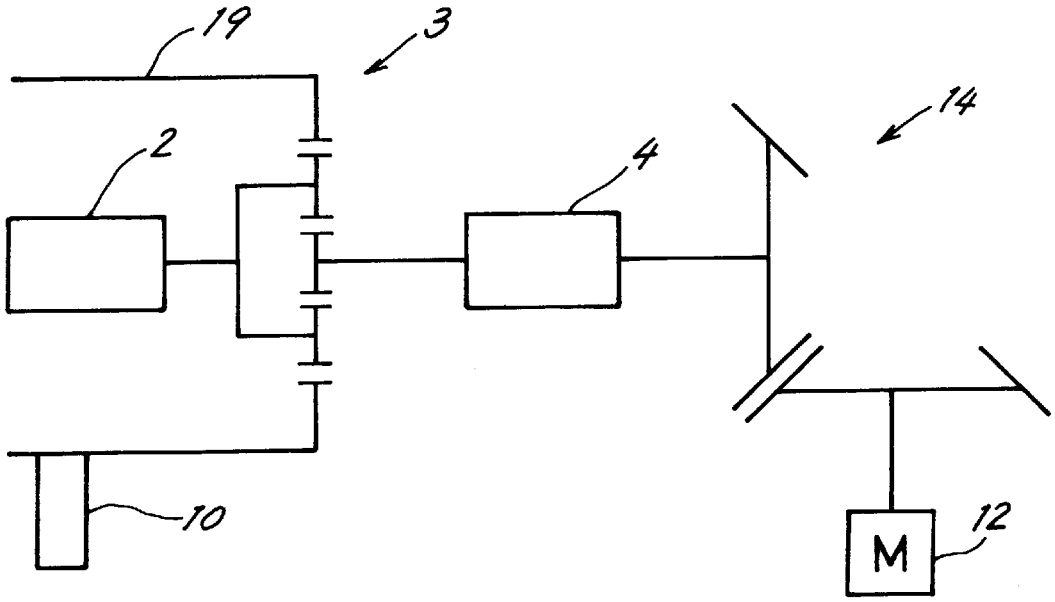
FIG. 10 is a diagram for illustrating the power transmission system of the tightening device.

Disposed around the forward end of the casing 1 is a ring 19 shown in FIG. 10 and rotatable in a reverse direction to the tightening socket 2 by the power dividedly delivered from the output dividing means. Projecting vertically from an outer peripheral portion of the ring 19 is a reaction arm 10 for receiving the tightening reaction acting on the casing 1 during tightening of a bolt and/or a nut.

The handle 11 is provided with a trigger 15 to be manipulated with the finger. A switch 17 for turning the socket drive motor 12 on or of f alternatively can be operated by the trigger 15.

A controller 13 is disposed between the motor 12 and the outer end of the handle 11 for detecting a load not smaller than a predetermined value and acting on the motor 12 from the variation of current value to deenergize the motor 12 independently of the manipulation of the trigger 15 and to momentarily energize a solenoid 43 serving as means for controlling the clutch 4 to be described later with a slight time delay after feeding a deenergization signal to the motor 12.

The time delay after the deenergization of the motor 12 until the energization of the solenoid 43 corresponds to the time taken for the motor, i.e., the tightening socket, to stop rotating in the meantime, and is controlled by a capacitor, timer, etc.

As shown in FIGS. 2 and 10, the device includes power transmission means which comprises the planetary gear reduction mechanism 3, a rotation transmitting gear train 14 and the clutch 4.

The planetary gear reduction mechanism 3 is provided by three planetary gear mechanisms as is conventionally the case with tightening devices of the type mentioned. An input planetary gear mechanism 31 at the rear side has a tubular sun gear 32, which is coupled to the motor 12 by the clutch 4 and the rotation transmitting gear train 14. A planetary gear mechanism at the front side has a planetary gear support frame 30 which is coupled to the socket 2.

The rotation transmitting gear train 14 includes a drive bevel gear 34 and a driven bevel gear 33 meshing with the gear 34. The driven bevel gear 33 is formed with an axial bore 33*a* having fitted therein the sun gear 32 of the input planetary gear mechanism 31. The rotation of the driven bevel gear 33 is transmitted to the sun gear 32 by the clutch 4.

The clutch 4 comprises the sun gear 32, a spool 41 slidably fitting in the sun gear 32, the solenoid 43 serving as clutch control means for slidingly driving the spool 41, and balls 42 for causing the sun gear 32 to rotate with the driven bevel gear 33.

Figure 3:
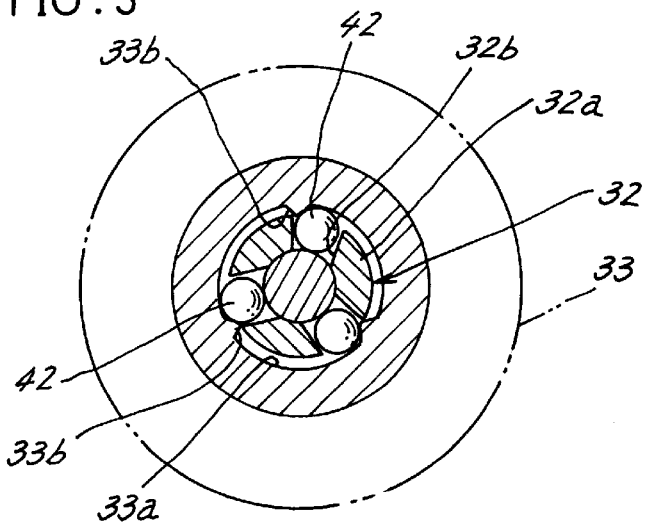
FIG. 3 is a view in section taken along the line A—A in FIG. 7.

As shown in FIG. 3, the inner periphery of the bevel gear 33 defining the axial bore 33*a* thereof is formed with three projections 33*b* equidistantly spaced apart circumferentially of the bore.

Figure 4:
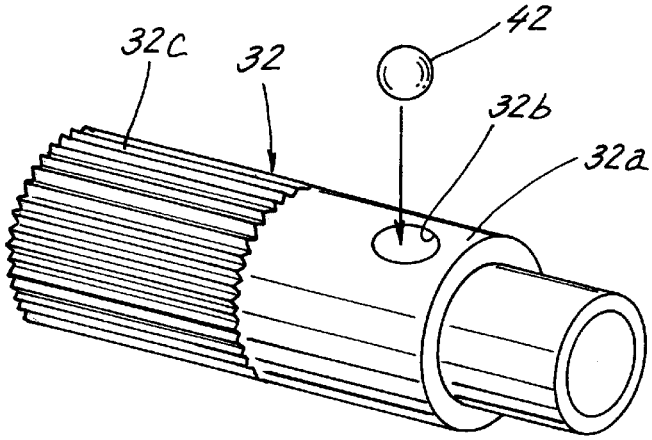
FIG. 4 is a perspective view of a sun gear.

With reference to FIG. 4, the sun gear 32 has a front portion having a toothed peripheral face 33*c*, and a tubular portion 32*a* integral with the front portion. The peripheral wall of the tubular portion 32*a* is formed with three bores 32*b* radially extending therethrough and equidistantly spaced apart circumferentially thereof. The balls 42 have a diameter greater than the wall thickness of the tubular portion 33*a* and are fitted in the respective bores 32*b*.

The sun gear 32 is inserted through the driven bevel gear 33 so that the balls 42 are positioned in coincidence with the projections 33*b* of the gear 33 with respect to the front-to-rear direction.

Figure 5:
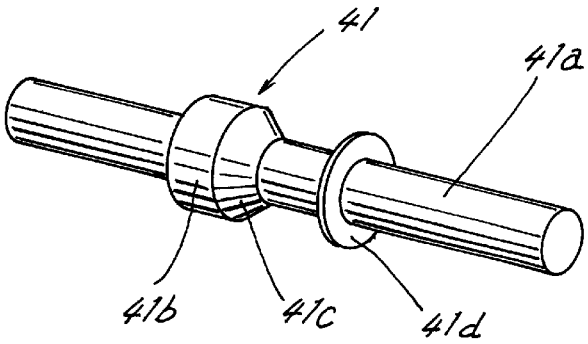
FIG. 5 is a perspective view of a spool.

With reference to FIG. 5, the spool 41 comprises a rod 41*a* having a large-diameter portion 41*b* approximately at the midportion of the rod 41*a* and a flangelike slide guide 41*d* to the rear of the portion 41*b*. The large-diameter portion 41*b* fitted in the sun gear 32 is opposed to the balls 42 and rotatable without being caught by the projections 33*b*.

The large-diameter portion 41*b* of the spool 41 has a rear end slanted radially inward toward the slide guide 41*d* to provide a tapered portion 41*c*.

The spool 41 is slidably fitted in the axial bore of the sun gear 32 and biased rearward along with a plunger 44 by a spring 45, causing the large-diameter portion 41*b* to outwardly push the balls 42 on the sun gear 32 into engagement with the respective projections 33*b* in the axial bore 33*a* of the driven bevel gear 33, whereby the clutch 4 is engaged to transmit the rotation of the gear 33 to the sun gear 32.

When the spool 41 advances against the spring 45, positioning the rod portion between the large-diameter portion 41*b* and the slide guide 41*d* as opposed to the balls 42, balls 42 retract, moving out of engagement with the respective projections 33*b* of the driven bevel gear 33. Thus, the clutch 4 is disengaged, permitting the bevel gear 33 to rotate idly with the sun gear 32 at rest.

The plunger 44 is disposed in the rear of the spool 41 in contact therewith and slidable axially of the spool. The solenoid 43 is provided around the front portion of the plunger 44 and around the rear portion of the spool 41.

When energized, the solenoid 43 exerts an attracting force on the plunger 44, advancing the plunger 44, which in turn advances the spool 41 to disengage the clutch 4 as described above.

On completion of a tightening operation, the controller 13 produces a signal, thereby energizing the solenoid 43 only for a moment to disengage the clutch 4, whereupon the spring 45 automatically returns the clutch 4 to the engaged state instantly. At this time, the balls 42 smoothly ride onto the large-diameter portion 41*b* and can be raised outward by being guided by the tapered portion 41*c* of the spool 41.

When tightening torque not smaller than a predetermined value acts on the socket 2, the controller 13 deenergizes the motor 12, and energizes the solenoid 43 after the socket 2 in rotation is brought to a halt as previously stated. When energized, the solenoid 43 moves the spool 41 to disengage the clutch 4, consequently removing residual torque from the shafting members included in the rotation transmitting gear train 14 to the bolt and/or nut and obviating biting engagement of the socket 2 with the bolt and/or nut.

With the biting engagement of the socket 2 with the bolt and/or nut eliminated, the socket 2 can be readily removed from the bolt and/or nut by pulling the tightening device out of engagement with the bolt and/or nut.

FIGS. 6 to 9 show embodiments of clutch control means wherein a spool 41 for a clutch 4 is mechanically coupled to a trigger 15 for turning a motor 12 on or off so as to engage or disengage the clutch 4 simultaneously with the energization or deenergization of the motor 12. The solenoid 43 included in the embodiment of FIG. 2 need not be used.

Figure 6:
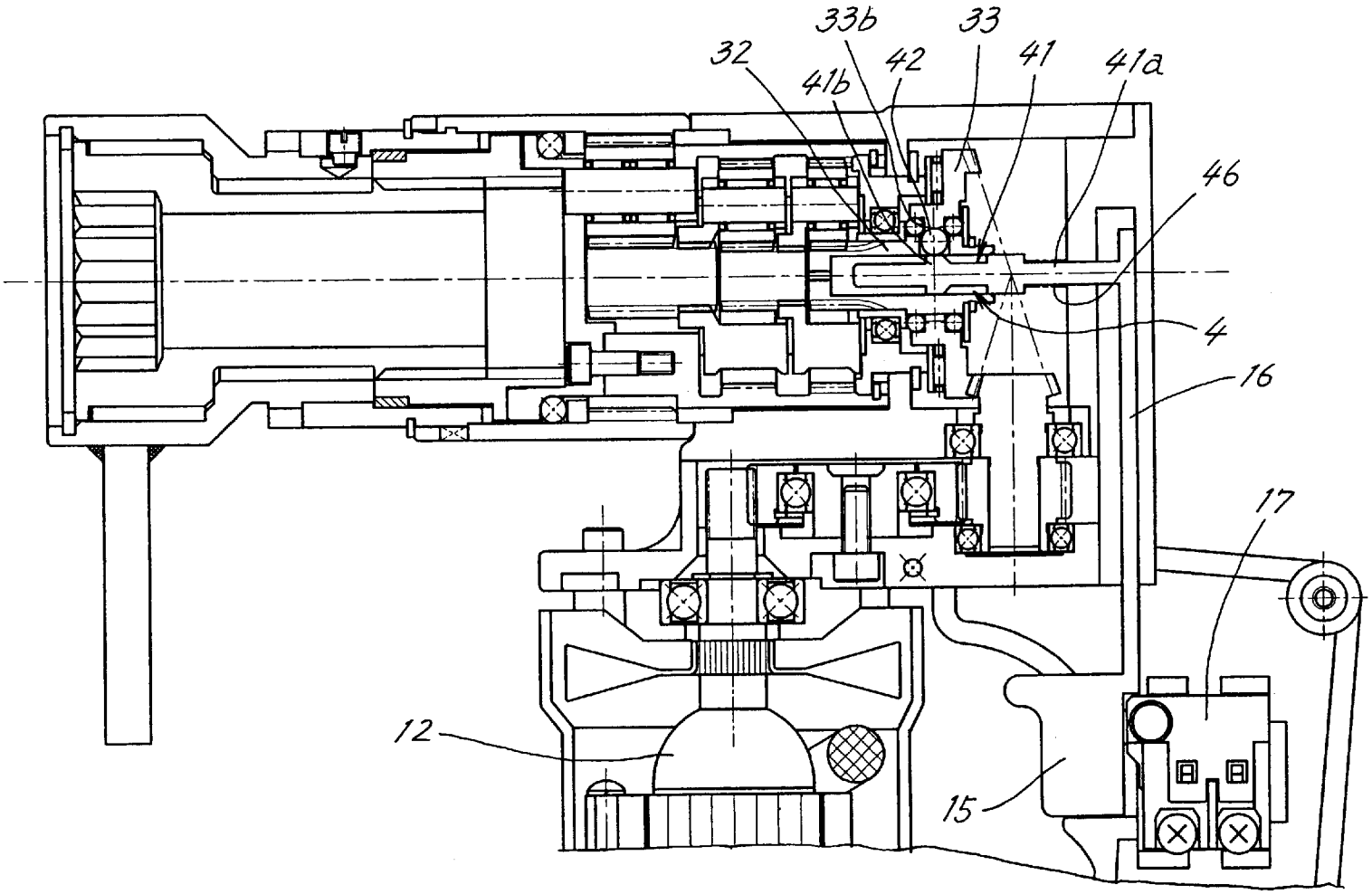
FIG. 6 is a sectional view showing a clutch operatively connected to a trigger and as engaged.
Figure 7:
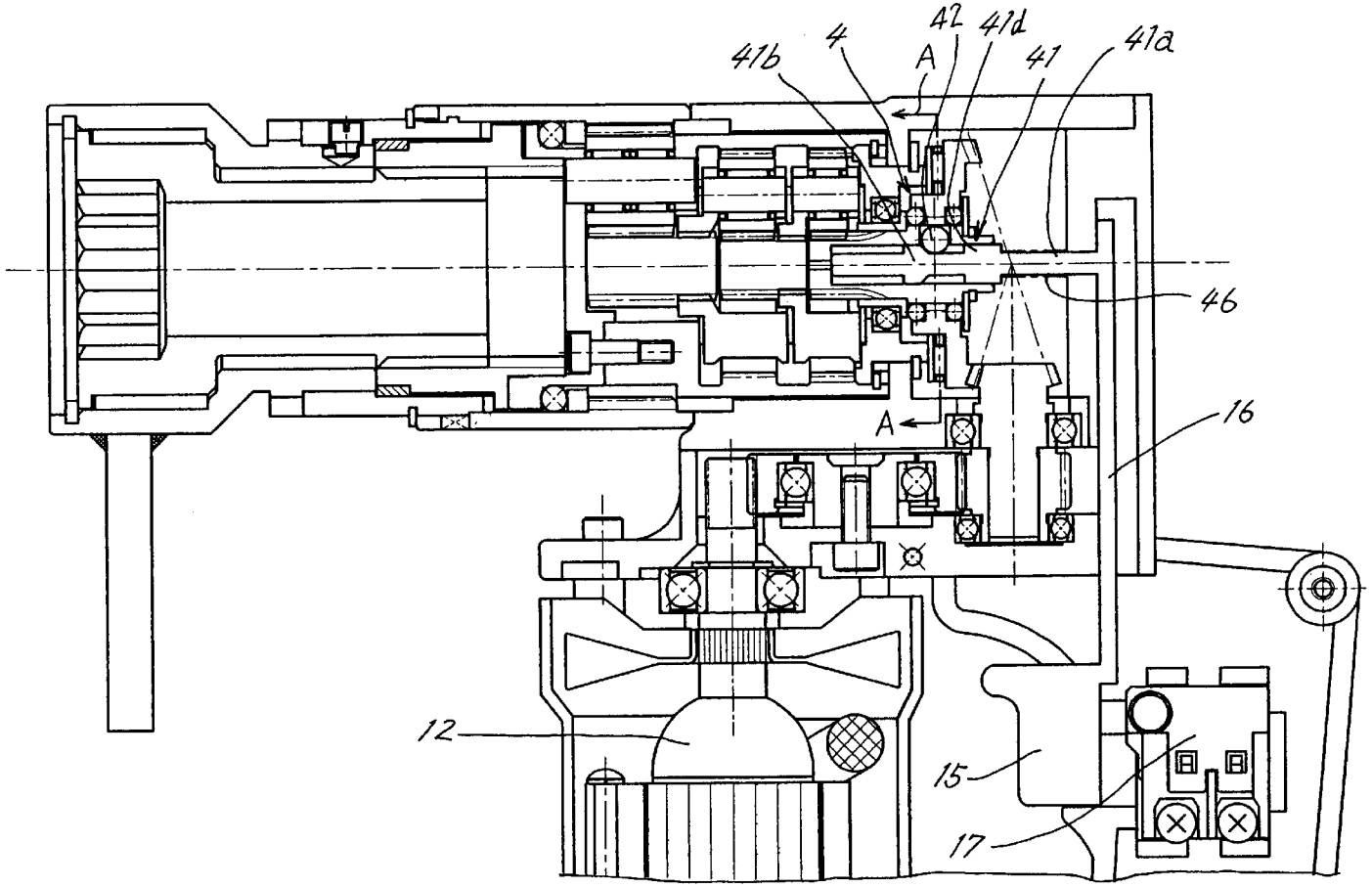
FIG. 7 is a sectional view showing the clutch as disengaged.

The clutch 4, driven bevel gear 33 and sun gear 32 shown in FIGS. 6 and 7 are the same as those shown in FIG. 1. The spool 41 comprises a rod 41*a* which extends rearward unlike the one shown in FIG. 1. An actuating piece 16 extending downward from the extension end is connected to the trigger 15, which is slidable. The trigger 15 is slidable forward and rearward, and a switch 17 is disposed to the rear of the trigger 15. The spool 41 is biased forward by a spring 46.

FIG. 6 shows the device in tightening operation, with the socket drive motor 12 energized by pulling the trigger 15 with the finger (not shown) and turning on the switch 17. The clutch 4 has its spool 41 moved rearward by the trigger 15, causing a large-diameter portion 41*b* of the spool 41 to push balls 42 outward into engagement with respective projections 33*b* on the inner periphery of the driven bevel gear 33. The clutch is engaged, holding a tightening socket 2 in rotation.

FIG. 7 shows the tightening device in a standby state. With the trigger 15 freed from the pull, the switch 17 is off, and the motor 12 is unenergized.

The spool 41 is advanced by the spring 46, with the spool portion between the large-diameter portion 41*b* and a slide guide 41*d* positioned as opposed to the balls 42 to hold the clutch 4 disengaged.

Figure 8:
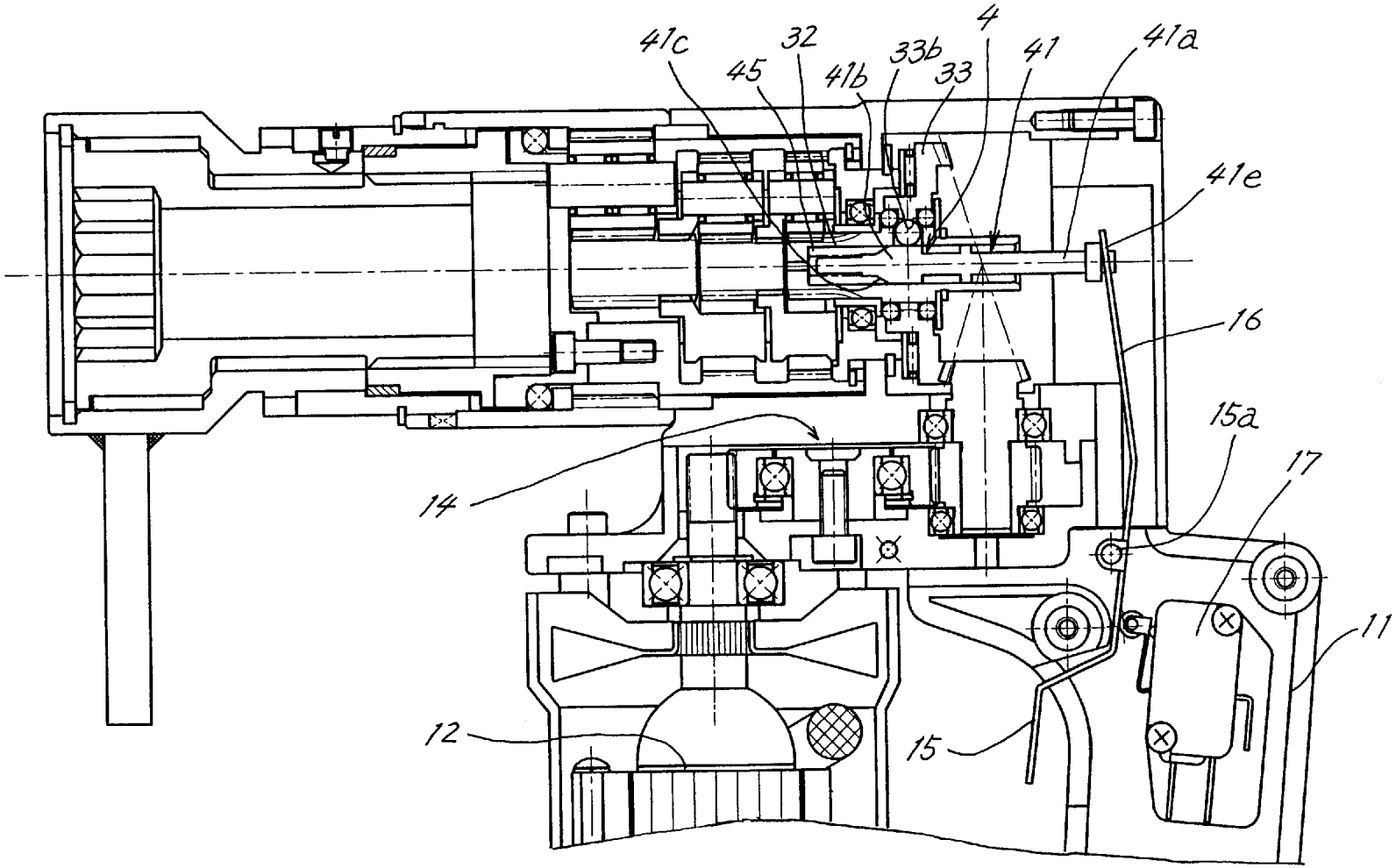
FIG. 8 is a sectional view showing another clutch operatively connected to a trigger and as engaged.
Figure 9:
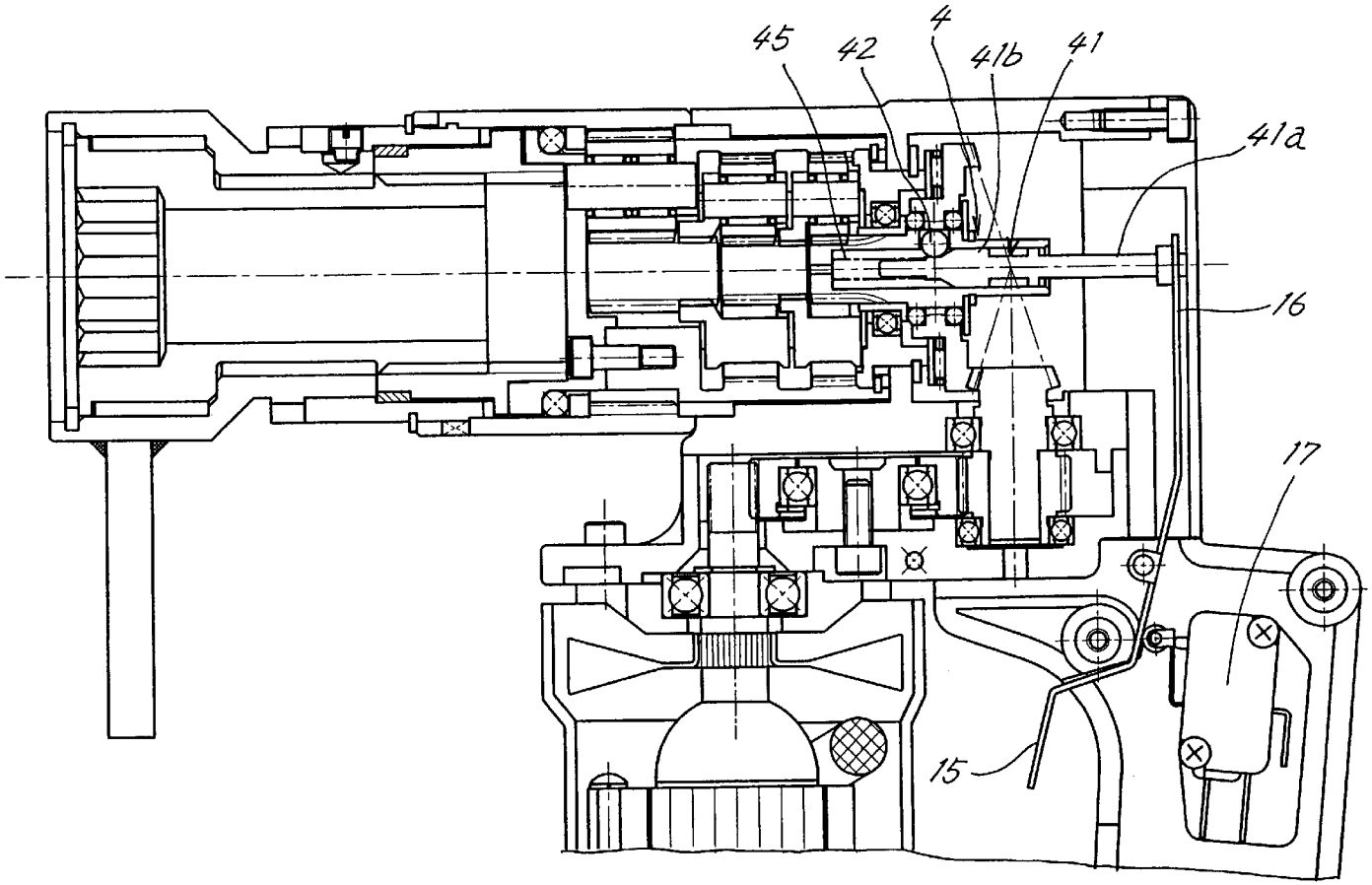
FIG. 9 is a sectional view showing the clutch as disengaged.

FIGS. 8 and 9 show a clutch 4 coupled to a pivotal trigger 15.

The clutch 4 has a driven bevel gear 33 and sun gear 32 which are the same as those shown in FIG. 1.

A spool 41 has a large-diameter portion 41*b* the front end of which is slanted radially inward toward the front to provide a tapered portion 41*c*. A rod 41*a* providing the spool 41 extends rearward, has a circumferential groove 41*e* at the extension end, and is biased rearward by a spring 45.

The trigger 15 is movable about a pivot 15*a*. In the vicinity of the pivot, an actuating piece 16 extends upward from the trigger 15 and is fitted at its upper end in the groove 41*e* of the spool 41.

FIG. 8 shows the device in tightening operation with a socket drive motor 12 energized by pulling the trigger 15 with the finger (not shown) and turning on the switch 17. The spool 41 is advanced by the actuating piece 16, causing the large-diameter portion 41*b* of the spool 41 to push balls 42 outward into engagement with respective projections on the inner periphery of the driven bevel gear 33 to engage the clutch.

FIG. 9 shows the tightening device in a standby state. With the trigger 15 freed from the pull, the switch 17 is off. The spool 41 is retracted by the spring 45, and the balls 42 are positioned in front of the large-diameter portion 41*b* of the spool 41 to hold the clutch 4 disengaged.

When tightening torque not smaller than a predetermined value acts on the socket 2 in the embodiments of FIGS. 6 to 9, the controller 13 deenergizes the motor 12, and the operator removes his pulling finger from the trigger 15 for the on-off control of the motor after the socket 2 in rotation is brought to a halt.

This permits the spool 41 coupled to the trigger 15 by the actuating piece 16 to return to a standby position under the action of the spring to disengage the clutch 4.

This movement removes the residual torque from the shafting members included in the rotation transmitting gear train 14 to the bolt and/or nut, obviating biting engagement of the socket 2 with the bolt and/or nut.

Apparently, the present invention can be modified or altered by one skilled in the art without departing from the spirit of the invention. Such modifications are included within the scope of the invention as set forth in the appended claims.

What is claimed is:

1. A device for tightening a bolt or a nut comprising a socket for tightening up the bolt or the nut, a socket drive motor for rotating the socket, and a controller for deenergizing the socket drive motor when tightening torque not smaller than a predetermined value acts on the socket, the bolt or nut tightening device being characterized in that the device comprises:

power transmission means for coupling the socket drive motor to the socket for power transmission, a clutch incorporated in the power transmission means for selectively effecting or interrupting power transmission from the socket drive motor to the socket by a sliding movement, and clutch control means for selectively moving the clutch to an engaged position or a disengaged position, the clutch being movable to the disengaged position by the clutch control means after the socket drive motor is deenergized, whereby residual torque delivered by the motor to the bolt or the nut is removed to preclude biting engagement of the socket with the bolt or nut.

2. A bolt or nut tightening device according to claim 1 wherein the power transmission means comprises an output dividing means for outputting the power of the socket drive motor dividedly to two systems downstream from the clutch, one of the outputs being transmitted to the socket, the other output being transmitted to a ring rotatably disposed around the socket and having a reaction arm for receiving a tightening reaction.

3. A bolt or nut tightening device according to claim 1 wherein the clutch control means is a solenoid controllable by the controller, and the controller operates the solenoid to move the clutch to the disengaged position after deenergizing the socket drive motor, whereby the residual torque delivered by the motor to the bolt and/or the nut is removed to preclude the biting engagement of the socket with the bolt or nut.

4. A bolt or nut tightening device according to claim 1 which comprises a trigger for controlling energization and deenergization of the socket drive motor, the trigger being biased in a deenergization direction by a spring and slidingly pushable in an energization direction against the spring when gripped by the user's hand, the clutch control means being coupled to the trigger to move the clutch to the engaged position when the trigger is moved in the energization direction and to move the clutch to the disengaged position when the trigger is moved in the deenergization direction.

* * * * *